US005468400A

United States Patent [19]

Michlin

[11] Patent Number: 5,468,400

[45] Date of Patent: Nov. 21, 1995

[54] LUBRICANT AND METHOD FOR LUBRICATING IMAGING MACHINE COMPONENTS

[76] Inventor: Steven B. Michlin, 5310 Bentley Suite 105, West Bloomfield, Mich. 48322

[21] Appl. No.: 236,374

[22] Filed: May 2, 1994

Related U.S. Application Data

[63] Continuation-in-part of Ser. No. 914,530, Jul. 17, 1992, Pat. No. 5,308,515.

[51] Int. Cl.[6] ..... C10M 103/00

[52] U.S. Cl. ..... 252/21; 252/20; 252/25; 427/429; 427/430.1

[58] Field of Search ..... 427/429, 430.1, 427/372.2, 435, 427; 252/21, 20, 25

[56] References Cited

U.S. PATENT DOCUMENTS

| | | | |
|---|---|---|---|
| 2,712,510 | 7/1955 | Machlet | 427/435 |
| 3,497,376 | 2/1970 | Weiser | 427/429 |
| 3,847,583 | 11/1974 | Dislich et al. | 427/435 |
| 3,947,609 | 3/1976 | Warner et al. | 427/435 |
| 4,552,676 | 11/1985 | Norris | 252/20 |
| 5,145,724 | 9/1992 | Yanai et al. | 427/430.1 |
| 5,154,039 | 10/1992 | Hanano | 252/20 |
| 5,308,515 | 5/1994 | Michlin et al. | 252/21 |
| 5,334,246 | 8/1994 | Pietrzykowski et al. | 427/430.1 |
| 5,403,665 | 4/1995 | Alley et al. | 427/435 |

*Primary Examiner*—Ellen M. McAvoy
*Assistant Examiner*—James M. Silbermann

[57] ABSTRACT

A padding powder suspension or slurry and method for applying a padding powder for lubricating components of printing, copy and facsimile machines such as the photoreceptor drum, photoreceptor belt, wiper and doctor blade. The padding powder is comprised of a mica-group mineral or a mixture of a mica-group mineral and calcium stearate. The method comprises mixing the padding powder with a solvent, for example alcohol, to form a different substance. The mica-group mineral is inert so it does not dissolve in the alcohol. A suspension agent or surfactant may also be mixed with the padding powder and alcohol to keep the padding powder suspended in the alcohol for a longer period of time. The resulting suspension or slurry is then applied on the components. The suspension or slurry may easily be applied with brushes, spray devices, sponge materials or a soft cloth. After the suspension or slurry is evenly applied on the components, the solvent and suspension agent evaporates and the padding powder dries to a thin residue. The result is an evenly distributed lubricant in the correct amount for optimum performance of the component, with no mess or waste of padding powder.

18 Claims, No Drawings

LUBRICANT AND METHOD FOR LUBRICATING IMAGING MACHINE COMPONENTS

BACKGROUND OF THE INVENTION

This application is a continuation-in-part of application Ser. No. 07/914,530, filed Jul. 17, 1992 now U.S. Pat. No. 5,308,515.

This invention relates to lubrication of photoreceptor drums and other components used in xerography and more specifically in the toner cartridge remanufacturing industry. This includes copiers, laser printers and facsimile machines which will be referred to throughout this text as imaging machines. However, it should be noted that the scope of this invention is not limited to imaging machines that use toner cartridges but includes all dry toner copiers, laser printers and facsimile machines.

CANON has designed an all-in-one cartridge as seen in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1994 at the time of this writing. When the long-life photoreceptor drum became available, the entire remanufacturing industry turned around and gained great strength and began a huge growth surge that still continues. In October 1993, HEWLETT-PACKARD, the largest seller of this printer type using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles. One good example is using an optimized drum lubricant. Typically, drum lubricants have been used on all imaging machines for years, regardless of what type of photoreceptor drums are being used. In the imaging machines that this inventor has personally worked with, only the OPC (Organic PhotoConductor) type drums have been used. However, there are many other coatings as well, all applicable to the invention, with no limit, many which have been tested by this inventor's customers.

After the science of xerography became popular, it became common practice for a drum lubricant or padding powder to be used. By "padding" the drum surface with a lubricant powder, the cleaning blade and photoreceptor drum life is enhanced. Of the early powders, zinc stearate was the most commonly used for many years, and is still a commonly used powder today. The idea is that zinc stearate will lubricate the drum and cleaning blade for around five pages after which the toner will begin lubricating. Zinc stearate is a hazardous substance and therefore, if someone would be exposed to it over years on a regular basis, they can develop pulmonary fibrosis. The powder is "padded" on and a little cloud of powder is generated with each application.

Then another common powder developed, made from a ground plastic KYNAR. KYNAR is a slightly better lubricant than zinc stearate and is not toxic like zinc stearate. However, being a powder, it is not good to breath all day long.

Remember, in a production operation, each employee does one specialized operation, and if one person does nothing but "pad" the photoreceptor drums, over the years the exposure to the dust can have an effect whether the dust is zinc stearate, KYNAR, cornflower, or any other powder. Another drawback is that when the powder is "padded", this cloud of powder is wasted. Furthermore, when the powder is padded on, there is no control over how much is applied. It may vary as much as 100% from one photoreceptor drum to the next.

Applicant is scheduled to receive U.S. Pat. No. 5,308,515 on May 3, 1994 for a method of lubrication using a different padding powder. This powder is composed of Mica mixed with 0–10 percent calcium stearate. This powder has different properties and has significant improvements over prior art. First, it has a much greater lubricity than zinc stearate and KYNAR. If you rub the powder between your index finger and thumb and do such a comparison of all three powders, an ordinary layman can easily feel the difference in lubricity. It feels much more slippery. Some of applicant's customers say it feels "slick". One major difference that this new powder has is that it will last for a full cartridge cycle. In other words, if a cartridge remanufacturer pads a photoreceptor drum and wiper blade, these components will still experience the lubrication properties beyond the 5 page limit of other powders, at 8,000 pages. This has been a significant benefit to the cartridge remanufacturing industry. It is estimated that applicant's powder is currently used by ten percent or more of the cartridge remanufacturing industry and a handful of service technicians in the copier industry, all customers of applicant.

One problem applicant has experienced on occassion with the powder is that some customers apply the powder too liberally. They really "pad" the powder on. Applicant's instruction sheet clearly states that one should wipe the powder off after application. However, some who use it do not have the time to read the instruction sheet. They simply pad the powder on very liberally. There are three problems with this. First, when the powder is liberally padded, it generates a dustcloud. Secondly, when the powder is liberally applied, it wastes powder. Thirdly, when the powder is overly padded, it causes an undesirable gray background on the output page. A page with a gray background is defective. Consequently, the overzealous worker who pads the powder (which is supposed to make the wearing components last longer) will cause a product failure. It is ironic that a "miracle" product that does so much good can cause failure if used improperly. Zinc stearate and KYNAR do not have this problem. With zinc stearate and KYNAR you may apply as much as you like, you may waste as much as you want without ill effect, detriment, or even a concern for product failure. That is one reason why the invention of this application had to be developed. With the powder of applicant's prior invention, applicant has only been able to tell customers to be cautious not to overpad the powder as a preventive measure.

SUMMARY OF THE INVENTION

Accordingly, it is an object of this invention to provide a method for applying a padding powder on imaging machine components to lubricate the components without waste of the padding powder.

It is another object of this invention to provide a method for applying a padding powder on the components in the correct amount so the operation of the components and the quality of the image are not adversely affected by padding powder too heavily applied.

It is a further object of this invention to provide a method for applying a padding powder in slurry form (or suspension) on imaging machine components, preventing the generation of clouds of padding powder dust.

A still further object of this invention is to provide a lubricating padding powder in initial slurry or suspension form for ease of application.

In carrying out this invention in the illustrative embodiment thereof, a mica-group mineral padding powder is mixed with alcohol to form a slurry or suspension. Many forms of alcohol may be used ranging from isopropyl alcohol, 99% isopropyl alcohol, denatured alcohol, ethanol, and other alcohol solvents and mixtures. The desirable property is quick evaporation. These various alcohols may also be mixed. A suspension agent or surfactant may also be used to keep the padding powder suspended in the alcohol for a longer period of time. The slurry or suspension is evenly applied on photoreceptor drums, photoreceptor belts, wiper blades, doctor blades, spreader blades, recovery blades, drum axles, gears, and other imaging machine components using conventional applicators such as brushes, spray devices, cotton swabs, and foam swabs. Once the suspension is applied on the imaging machine components, the alcohol and suspension agent evaporate leaving a thin residue of lubricant on each component. Unlike liquid/greasy lubricants that attract toner to develop a black mess, the mica based lubricant will not collect toner like grease does and even repels toner from sticking to it. The liquified slurry/suspension version of the padding powder will therefore not be applied too heavily and is technician-proof. In other words, the person applying the padding powder will be much more likely to apply the correct amount, eliminating waste of the padding powder and allowing optimum performance of the imaging machine. Furthermore, "overpadding", which can cause severe imaging problems, will not occur.

COMPLETE DESCRIPTION OF THE PREFERRED EMBODIMENT

In applicant's U.S. Pat. No. 5,308,515, a method was disclosed for minimizing wear and tear on photoreceptor drums, wiper blades and doctor blades used on dry toner printers, copiers and facsimile machines. The method used a padding powder to lubricate the drum and blades. The padding powder was comprised of 90 percent by weight or more of a mica-group mineral, such as muscovite or phlogopite. The mica-group mineral was wet-ground to attain cold, dry lubricity, resiliency and particle alignment. Calcium stearate was used as an optional ingredient at ten percent by weight or less to increase the lubricity of the padding powder and reduce static electricity generated from the photoreceptor drum, blades, environmental conditions, or other causes during operation of the imaging machine.

The padding powder was applied to the photoreceptor drum by using a cloth bag. The cloth bag, filled with the padding powder, was tapped or rubbed against the drum to cause a cloud of padding powder which would adhere to the drum. The wiper and doctor blades were dipped into a receptacle filled with the padding powder to coat and lubricate the blades. Applicant's U.S. Pat. No. 5,308,515 is incorporated herein by reference.

A new method has been developed to apply the padding powder on the toner cartridge and imaging machine components. This new method is intended to prevent the padding powder from being over applied and wasted. The padding powder, comprising the mica-group mineral or the mica-group mineral combined with calcium stearate, is mixed with alcohol to form a new substance. Mica is an inert mineral. It will only dissolve in strong acids such as hydrochloric, sulfuric, or hydroflouric varieties. Consequently, mica will not dissolve in solution for a simpler product. So, the padding powder mixed with alcohol forms a slurry or suspension. The slurry or suspension is then applied to the components, such as the photoreceptor drum, photoreceptor belt, wiper or cleaner blade, doctor or spreader blade, drum axles and all moving parts of an imaging machine.

Since the slurry/suspension has liquid properties, it may be applied on the components with a brush, sponge, or other sponge-like material, foam, cotton swab, foam swab, shoe polish applicator, paint roller or brush, foam paint brush, cotton pad or a soft cloth. The slurry/suspension may be spray applied, as by a spray paint or air brush device, or the slurry may be sprayed from a bottle through the use of a pump-cap. Some of the components, for example the blades, may be dipped into a receptacle containing the slurry/suspension.

After the slurry or suspension is applied to the components, the alcohol will evaporate and the padding powder will dry, leaving a thin residue of lubricant on the components. The result is an evenly applied padding powder in the correct amount for optimum performance. No dust cloud is formed and no padding powder is wasted. The output page of the imaging machine will not have a gray background caused by an overly padded photoreceptor drum. The quality of the image is enhanced. The imaging machine runs smoothly and the lubricated components have longer lives.

Solvents other than alcohol may be used to form the slurry, but alcohol seems to work best and there are some dangers involved with using other types of solvents. Acetone, MEK, MIBK, toluene, ether, ethyl acetate, and amyl acetate may be applicable. Acetone, for example, evaporates faster than alcohol but is so strong that it would dissolve the photoconductive coating on the drum, making the photoreceptor drum unusable. Many common organic solvents are like acetone in this respect. MEK, MIBK and other highly evaporative solvents tend to dissolve and thereby remove the photoconductive coating from the drum. However, it is anticipated, as new jet age coatings are developed, that some of them will inevitably be used to coat drums for longer life and durability. It is also anticipated that some will be used in the mix with photoconductive materials, not just as a protective overcoating. Consequently, it is inevitable that photoconductive coatings may change with new scientific breakthroughs in the xerography field, and stronger solvents may not dissolve improved coatings. If or when that day comes, acetone and other similar highly evaporative organic solvents as well as inorganic solvents may be used to replace alcohol in the slurry or suspension for faster evaporation time. Using acetone would speed up the process of lubricating the components. Therefore, the method of applying the padding powder in this invention also includes using acetone or other strong, fast evaporating solvents to form a slurry or suspension even though technology may not have yet advanced enough for this embodiment.

Wetting agents, suspension agents or surfactants may be used to help keep the mica or mica-calcium stearate padding powder in suspension in the alcohol. These agents or surfactants would slow down the settling time or prevent the settling of the padding powder within the slurry or suspension. So, after shaking the slurry or suspension, settling of the mica or mica-calcium stearate would be minimized, ensuring an even distribution of the padding powder within the slurry for smooth and efficient application of the padding powder slurry or suspension on the imaging machine components. The agents or surfactants evaporate with the alcohol or other solvent used to form the slurry or suspension.

Many agents or surfactants are available for this function, though there may be some variation in their performance of suspending the padding powder in the solvent. Applicant has chosen three agents as examples. All three are made by Union Carbide. The first is TERGITOL 15-S-7 Surfactant. The second is called TRITON GR-5M Surfactant. The third is called TRITON X-100 Surfactant.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of the invention as claimed in the following claims and as suggested by reasonable equivalents to the claimed elements.

What is claimed is:

1. A method for applying a lubricating powder on components of printing, copy, and facsimile machines, said lubricating powder comprising a mica-group mineral, said method comprising mixing said lubricating powder with a solvent to form a slurry or suspension, applying said slurry or suspension on said components, and then allowing said solvent to evaporate.

2. A method as in claim 1 wherein said solvent is alcohol.

3. A method as in claim 1 wherein said solvent is acetone.

4. A method as in claim 1 wherein said lubricating powder comprises a mixture of 90 percent by weight or more of a mica-group mineral and ten percent by weight or less of calcium stearate.

5. A method as in claim 4 wherein a suspension agent is also mixed into said slurry to keep said lubricating powder suspended in said slurry for a longer period of time.

6. A method as in claim 1 wherein a suspension agent is also mixed into said slurry to keep said lubricating powder suspended in said slurry for a longer period of time.

7. A method as in claim 1 wherein said slurry is applied on said components by a brush.

8. A method as in claim 1 wherein said slurry is applied on said components by a spray device.

9. A method as in claim 1 wherein said slurry is applied on said components by a soft cloth.

10. A method as in claim 1 wherein said slurry is applied on said components by a sponge material.

11. A method as in claim 1 wherein said slurry is applied on said components by dipping said components in a receptacle filled with said slurry.

12. A method as in claim 1 including the step of mixing a surfactant with said slurry or suspension to help keep said lubricating powder in suspension.

13. A lubricant means for minimizing wear and tear on components of printing, copy and facsimile machines, wherein said lubricant means is a lubricating powder in initial suspension or slurry form for ease of application, said lubricating powder in initial suspension or slurry form comprising a mixture including a mica-group mineral and alcohol.

14. A lubricant means as in claim 13 wherein said mixture further includes a suspension agent to keep said mica-group mineral suspended in said solvent for a longer period of time.

15. A lubricant means as in claim 13 wherein said mixture further includes a surfactant to help keep the mica-group mineral in suspension.

16. A lubricant means for minimizing wear and tear on components of printing, copy and facsimile machines, wherein said lubricant means is a lubricating powder in initial suspension or slurry form for ease of application, said lubricating powder in initial suspension, or slurry form comprising a mixture including a mica-group mineral and a solvent, said mixture also including calcium stearate to reduce static electricity created during operation of said machines.

17. A lubricant means as in claim 16 wherein said mixture further includes a suspension agent to keep said mica-group mineral and said calcium stearate suspended in said solvent for a longer period of time.

18. A lubricant means as in claim 16 wherein said mixture further includes a surfactant to help keep the mica-group mineral and calcium stearate in suspension.

* * * * *